US005645981A

United States Patent [19]

Romanet et al.

[11] Patent Number: 5,645,981

[45] Date of Patent: Jul. 8, 1997

[54] PHOTOGRAPHIC SILVER HALIDE MATERIALS AND PROCESS COMPRISING A PYRAZOLOTRIAZOLE COUPLER

[75] Inventors: Robert Fogg Romanet; Arlyce Tolman Bowne, both of Rochester; Sharon Eileen Normandin, Macedon, all of N.Y.

[73] Assignee: Eastman Kodak Company, Rochester, N.Y.

[21] Appl. No.: 225,417

[22] Filed: Apr. 6, 1994

Related U.S. Application Data

[63] Continuation of Ser. No. 931,102, Aug. 14, 1992, abandoned, which is a continuation of Ser. No. 592,146, Oct. 3, 1990, abandoned, which is a continuation of Ser. No. 241,513, Sep. 7, 1988, abandoned, which is a continuation-in-part of Ser. No. 23,519, Mar. 9, 1987, abandoned.

[51] Int. Cl.[6] ..... G03C 7/38

[52] U.S. Cl. ..... 430/558; 430/386; 430/387

[58] Field of Search ..... 430/558, 386, 430/387

[56] References Cited

U.S. PATENT DOCUMENTS

| | | | |
|---|---|---|---|
| 3,725,067 | 4/1973 | Bailey et al. | 430/558 |
| 4,443,536 | 4/1984 | Lestina | 430/552 |
| 4,500,630 | 2/1985 | Sato et al. | 430/386 |
| 4,540,654 | 9/1985 | Sato et al. | 430/381 |
| 4,543,323 | 9/1985 | Iijima et al. | 430/503 |
| 4,548,899 | 10/1985 | Nakayama et al. | 430/558 |
| 4,791,052 | 12/1988 | Kida et al. | 430/558 |
| 4,835,094 | 5/1989 | Wolff et al. | 430/558 |
| 4,942,118 | 7/1990 | Normandin et al. | 430/558 |
| 4,992,361 | 2/1991 | Bowne et al. | 430/558 |

FOREIGN PATENT DOCUMENTS

| | | | |
|---|---|---|---|
| 0135883 | 4/1985 | European Pat. Off. . | |
| 0192199 | 8/1986 | European Pat. Off. . | |
| 58-134633 | 8/1983 | Japan | 430/387 |
| 61-028947 | 2/1986 | Japan | 430/558 |
| 1247493 | 11/1967 | United Kingdom . | |
| 1252418 | 11/1967 | United Kingdom . | |
| 1398979 | 12/1971 | United Kingdom . | |
| 2135788 | 9/1984 | United Kingdom . | |

OTHER PUBLICATIONS

Research Disclosure No. 20919, Research Disclosure, vol. 209, 1981 Kenneth Mason Publications Ltd., Hampshire, England.

Research Disclosure No. 12443, *Research Disclosure,* vol. 124, 1974 Kenneth Mason Publications Ltd., Hampshire, England.

Research Disclosure No. 17643, *Research Disclosure,* vol. 176, 1978 Kenneth Mason Publications Ltd., Hampshire, England.

Research Disclosure No. 25758, *Research Disclosure,* vol. 257, 1985 Kenneth Mason Publications Ltd., Hampshire, England.

*Primary Examiner*—Lee C. Wright

*Attorney, Agent, or Firm*—Arthur E. Kluegel

[57] ABSTRACT

Novel pyrazolotriazole dye-forming couplers contain an aliphatic or aromatic aryl ballast group and having one carboxy or sulfonic group on the ballast group enabling the pyrazolotriazole to have increased activity and having an ether (—O—) group or group A bonded directly to a carbon atom or arylene group that is bonded directly to the pyrazolotriazole nucleus and wherein the pyrazolotriazole is capable of forming an immobile dye in a gelatino silver halide emulsion and is free of coupling-off groups that reduce silver. When the ballast group is bonded to the pyrazoloazole nucleus by means of an aromatic group, the aromatic group is ortho substituted. Group A is $$-\overset{\overset{\displaystyle O}{\|}}{C}O-,$$

—S—, —SO—, —$SO_3$—, or —$OSO_2$—. The ether group or group A enables the dye formed to have desired hue. These couplers are useful in photographic silver halide materials and processes.

15 Claims, No Drawings

PHOTOGRAPHIC SILVER HALIDE MATERIALS AND PROCESS COMPRISING A PYRAZOLOTRIAZOLE COUPLER

This is a Continuation of application U.S. Ser. No. 931,102, filed 14 Aug. 1992, which is a continuation of application Ser. No. 592,146, filed 03 Oct. 90, which in turn is a continuation of application Ser. No. 241,513, filed 07 Sep. 88, which in turn is a continuation-in-part of application Ser. No. 023,519, filed 09 Mar. 87, all abandoned.

This invention relates to novel pyrazolo-triazole couplers and to photographic silver halide elements and processes using such couplers.

Color images are customarily obtained in the photographic art by reaction between the oxidation product of a silver halide color developing agent and a dye-forming coupler. Pyrazolone couplers are useful for forming magenta dye images. Pyrazolotriazole couplers represent another class of couplers that are useful for this purpose. Examples of pyrazolotriazole couplers are disclosed in, for instance, U.S. Pat. No. 4,443,536; U.K. Patents 1,247,493; 1,252,418 and 1,398,979. An example of such a coupler is represented by the formula C-1:

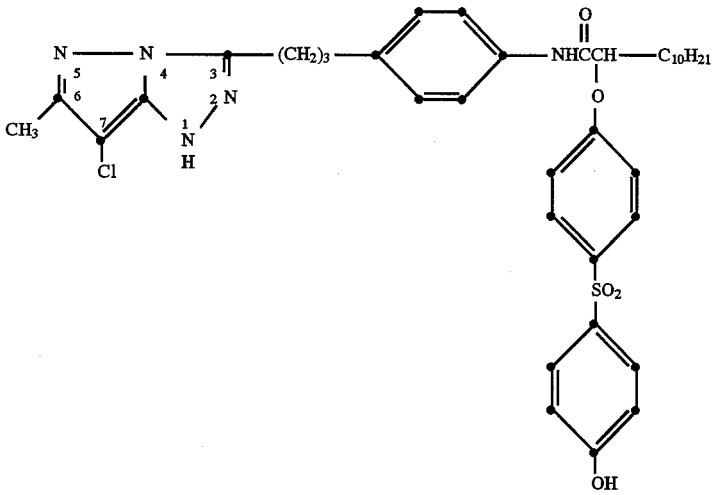

C-1

While such magenta dye-forming couplers are useful in photographic silver halide materials and processes, many such couplers do not have the combination of desired degree of reactivity while enabling desired hue in the dye formed. Sufficient reactivity herein means the ability of the coupler to form the concentration of magenta dye that is desired and to enable the formation of desired maximum dye image density upon oxidative coupling. It has been desired to provide pyrazolotriazole couplers that have increased reactivity over those described in the patent cited above and provide magenta dyes having desired hue and that do not move to other locations in the photographic element containing them, that is provide magenta dyes that are substantially immobile.

It has been found that such advantages are provided by novel pyrazolotriazole couplers that comprise an aliphatic or ortho substituted aryl ballast group, preferably having 14 to 40 carbon atoms, and having one water-solubilizing group, preferably one carboxy group or one sulfonic acid group on the ballast group enabling the pyrazolotriazole to have increased activity;

having an ether (—O—) group or a group A bonded directly to a carbon atom or arylene group, preferably a phenylene group, bonded directly to the pyrazolotriazole nucleus;

and, wherein the pyrazolotriazole is capable of forming an immobile dye in a gelatino silver halide emulsion and is free of coupling-off groups that reduce silver. When the ballast group is bonded directly to the pyrazolotriazole nucleus by means of the arylene group, the arylene group is ortho substituted, preferably ortho substituted by an alkyl group or alkoxy group, to enable the dye formed from the coupler to have desired hue. Group A is $$-\overset{\overset{\displaystyle O}{\|}}{C}O-,$$

—S—, —SO—, $—SO_3—$, or $—OSO_2—$.

Such a pyrazolotriazole is, for example, a 1H-pyrazolo-[3,2-c]-s-triazole or a 1H-pyrazolo-[2,3-b]-s-triazole. A 1H-pyrazolo[2,3-b]-s-triazole herein can also be named as a 1H-pyrazolo[1,5-b]-1,2,4-triazole. The latter nomenclature has been used in the photographic art in, for example, U.S. Pat. No. 4,540,654.

It has been found that the one water-solubilizing group, particularly one carboxy group or one sulfonic acid group, on the ballast group provides the desired degree of water solubilization of the pyrazolotriazole coupler. The increased water solubilization considered with other properties of the coupler enables increased reactivity. If a coupler has too much water solubilization, as ballast groups containing multiple water solubilizing groups, the resulting dye from oxidative coupling is not immobile and can wander to undesired locations in a photographic element. It has been known in the photographic art to use a ballast group on a coupler to enable formation of a dye that is immobile in a photographic element; however, it is surprising that the presence of a water solubilizing group on a ballast of a pyrazoloazole, particularly a carboxy group or sulfonic acid group on a ballast group as described, with an ether (—O—) group or group A bonded directly to a carbon atom or arylene group bonded directly to the pyrazolotriazole coupler enables increased reactivity without adverse mobility of the resulting image dye and enables desired hue in the dye formed.

Any ballast group as described containing the water-solubilizing group, preferably the carboxy group, and the ether (—O—) group or group A is useful on the pyrazolotriazole coupler. The ballast group contains a sufficient number of carbon atoms to enable the dye formed from the coupler to be immobile in a gelatino silver halide emulsion. The ballast group for this purpose preferably contains 14 to 40 carbon atoms.

The ballast group is an aliphatic or aromatic ballast group, preferably comprising 14 to 40 carbon atoms. The ballast group enables the dye formed from the pyrazolotriazole to be immobile in a gelatino silver halide emulsion. When the ballast group is bonded to the pyrazolotriazole nucleus by means of an arylene group, the arylene group is ortho substituted. The ortho substituent on the arylene group enables formation of a magenta dye of desired hue. A preferred ballast group as described comprises a secondary carbon atom bonded directly to the pyrazolotriazole nucleus and bonded directly to an ether group.

A preferred ballast group is represented by the following formula:

$$-\underset{|}{Y}-(X)_m-(L-W)_n-L^1\text{-SOL}$$

wherein

Y is $$-\overset{R_1}{\underset{R_2}{C}}-$$

or arylene, preferably phenylene containing an ortho substituent, preferably alkyl or alkoxy;

X is a group capable of controlling the hue of the dye formed from the coupler, particularly a group selected from —O—, $$-\overset{O}{\overset{\|}{C}}O-,$$

—S—, —SO—, —$SO_3$—, and —$OSO_2$—; preferably —O—;

m is 1;

L and $L^1$ individually are unsubstituted or substituted hydrocarbon groups, such as unsubstituted or substituted alkylene containing 1 to 20 carbon atoms; unsubstituted or substituted arylene, preferably unsubstituted or substituted phenylene; aralkylene; alicyclic; or heterocyclic groups;

W is a group selected from: —O—, $$-\overset{O}{\overset{\|}{C}}O-,\ -\overset{O}{\overset{\|}{C}}O-,$$

—S—, —SO—, —$SO_3$—, —$OSO_2$—, —$NR_{3a}$—, —$NR_{3a}CO$—, —$NR_{3a}CONR_{2a}$—, —$CONR_{4a}$—, —$NR_{3a}SO_2$—, —$NR_{3a}SO_2NR_{4a}$—, and —$SO_2NR_{4a}$—;

$R_1$ and $R_2$ individually are hydrogen, alkyl, aryl, alkoxy, alicyclic, or heterocyclic substituents; or $R_1$ and $R_2$ or L can represent the atoms necessary to complete an alicyclic or heterocyclic ring, for example, $R_1$ and $R_2$ together can represent the atoms necessary to complete a 5- or 6-member ring;

$R_{2a}$, $R_{3a}$ and $R_{4a}$ individually are hydrogen, alkyl, aryl, alicyclic or heterocyclic substituents;

n is 0 or a positive integer, preferably 1, 2 or 3, provided that L and W individually can be the same or different from the other L and W groups; and, SOL is a water-solubilizing group selected from carboxy (—COOH) and sulfonic acid (—$SO_3H$) groups. A preferred ballast group is represented by the formula:

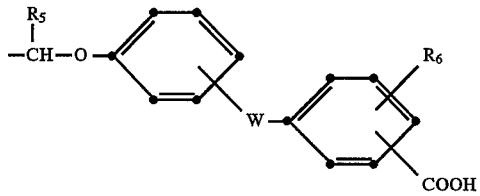

wherein

W is as defined, preferably —$NR_3SO_2$—;

$R_5$ is a substituent, preferably alkyl, such as alkyl containing 1 to 30 carbon atoms, for example methyl, ethyl, propyl, butyl, decyl, and eicosyl; and, $R_6$ is hydrogen or a substituent, such as hydroxy, alkyl or alkoxy.

The aromatic ballast group as described is typically an aryl group, such as a phenyl or naphthyl group, containing on the ring, in the position ortho to the carbon atom bonded to pyrazolotriazole nucleus, B substituent that typically increases the desired properties, particularly the hue of the dye formed from the pyrazolotriazole coupler. The ortho substituent on the aryl ballast group includes those groups, described in the copending application Ser. No. 23,517 of Bowne, Clarke, Milner and Normandin, entitled, Photographic Silver Halide Materials and Process Comprising a Pyrazoloazole Coupler, filed Mar. 9, 1987, the disclosure of which is incorporated herein by reference. The ortho substituted aryl ballast group is typically an aryl group represented by the formula:

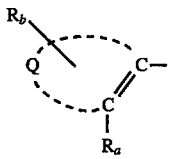

wherein $R_a$ is an ortho substituent that enables the dye formed from the coupler to have desired hue. $R_a$ is preferably unsubstituted or substituted alkoxy, such as alkoxy containing 1 to 30 carbon atoms, for example, methoxy, ethoxy, propoxy, butoxy, decyloxy, and eicosyloxy; halogen, such as chlorine, bromine, and fluorine; or alkyl, such as unsubstituted or substituted alkyl containing 1 to 30 carbon atoms, for example, methyl, ethyl, propyl, butyl, pentyl, and eicosyl; Q represents the atoms necessary to complete an aryl group, such as a phenyl or naphthyl group. The $R_b$ group represents a carboxy group or a sulfonic acid group or a substituent containing one carboxy group or one sulfonic acid group.

The ballast group is, as described, additionally optionally substituted with groups that do not adversely affect the coupler or the dye formed from the coupler. The ballast group can, for example, be optionally substituted with, halogen, such as chlorine, bromine and fluorine; alkyl, such as alkyl containing 1 to 30 carbon atoms, for example, methyl, ethyl, propyl, t-butyl, n-butyl and eicosyl; cycloalkyl, such as cyclohexyl and cyclopentyl; alkoxy, such as alkoxy containing 1 to 20 carbon atoms, for example, methoxy, propoxy, butoxy and dodecyloxy; amino, such as dioctylamino, anilino, and dimethylamino; carbonamido, such as acylamino containing 1 to 20 carbon atoms, for example acetamido, stearamido, ureido, and benzamido; alkylthio, such as alkylthio containing 1 to 20 carbon atoms, for example methylthio, ethylthio, and dodecylthio; aryl, such as aryl containing 6 to 30 carbon atoms, for example phenyl and naphthyl; aryloxy, such as aryloxy containing 6 to 20 carbon atoms, for example phenoxy and naphthoxy; cyano; nitro; arylthio, such as arylthio containing 1 to 20 carbon atoms, for example phenylthio and naphthylthio; sulfamyl, such as methylsulfamyl, butylsulfamyl and phenylsulfamyl; sulfonamido, such as methanesulfonamido and benzenesulfonamido; sulfone; sulfoxide; —$SO_3$—; —$OSO_2$—; or a heterocyclic group comprised of atoms selected from carbon, nitrogen, oxygen and sulfur atoms necessary to complete a 5- or 6-member ring, for example a pyrrolyl, oxazolyl, or pyridyl ring.

Examples of useful ballast groups containing the carboxy group are as follows:

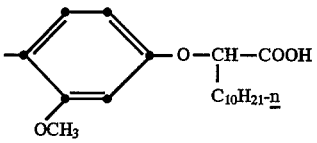

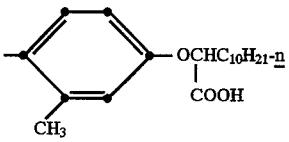

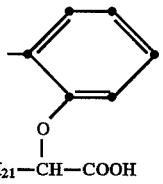

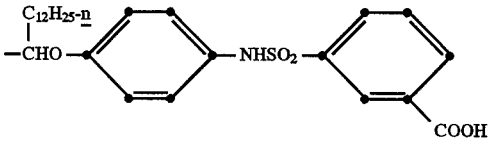

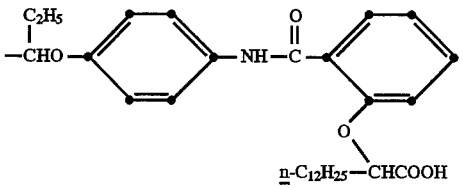

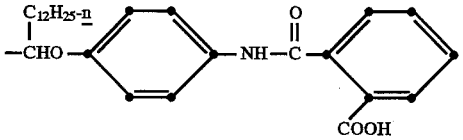

-continued

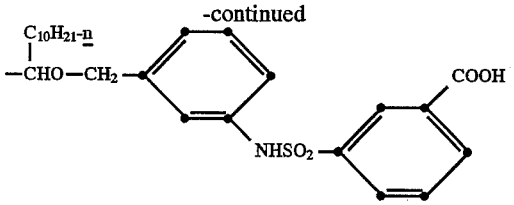

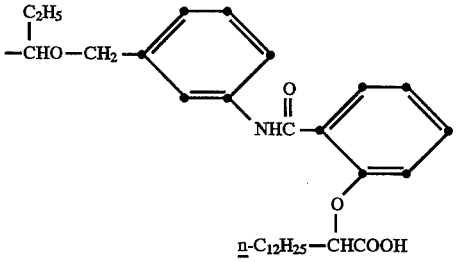

Illustrative examples of a 1H-pyrazolo-[3,2-c]-s-triazole and a 1H-pyrazolo[2,3-b]-s-triazole are represented by formula II and formula III, respectively:

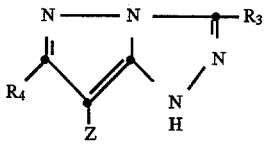

II

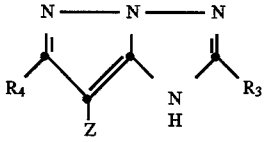

III wherein

Z is hydrogen or a coupling-off group incapable of reducing silver;

$R_3$ and $R_4$ are individually hydrogen or a substituent that does not adversely affect the coupler or the dye formed from the coupler, and wherein at least one of $R_3$ and $R_4$ is a ballast group, as described.

The pyrazolotriazole coupler typically contains in a position not occupied by Z or a ballast group as described, a substituent that does not adversely affect the desired properties of the coupler or the dye formed from the coupler. Such a substituent in a position not occupied by Z or a ballast group as described typically can aid such properties as solubility, diffusion resistance, dye hue and the like. For example, the pyrazolotriazole can contain in such a position, amino, such as dioctylamino, ethylhexylamino and anilino; acylamino, such as acetamido, benzamido and stearamido; ureido; carboxy; aryl, such as aryl containing 6 to 40 carbon atoms, for example, phenyl, naphthyl, carboxyphenyl; alkyl, such as alkyl containing 1 to 40 carbon atoms, for example, methyl, ethyl, propyl, t-butyl, n-butyl, actyl and eicosyl; and a heterocyclic group, such as a heterocyclic group containing the atoms selected from carbon, nitrogen, oxygen and sulfur atoms necessary to form a 5- or 6-member heterocyclic group, such as pyrrolyl, oxazolyl and pyridyl. Such groups in this position are unsubstituted or optionally substituted with groups that do not adversely affect the coupler or the dye formed. For example, the group can be substituted with carboxy, alkyl, such as alkyl containing 1 to 30 carbon atoms, for example methyl, ethyl, propyl, butyl and eicosyl; aryl, such as aryl containing 6 to 30 carbon atoms, for example phenyl, naphthyl and mesityl; cyano; nitro; a heterocyclic group, such as a heterocyclic group comprised of atoms selected from carbon, oxygen, nitrogen and sulfur atoms necessary to complete a 5- or 6-member ring, such as a pyrrolyl, oxazolyl, and pyridyl; or, $W_1$–$R_7$. Such groups are unsubstituted or optionally substituted with groups that do not adversely affect the coupler or dye formed from the coupler.

$W_1$ is a linking group that does not adversely affect the desired properties of the coupler and the dye formed. $W_1$ is, for example, $$-O-,\ -\overset{O}{\overset{\|}{C}}-,\ -O\overset{O}{\overset{\|}{C}}-,\ -\overset{O}{\overset{\|}{C}}-O-,\ -\overset{R_8}{\overset{|}{N}}-,\ -\overset{R_8}{\overset{|}{N}}-\overset{O}{\overset{\|}{C}}-,$$

$$-\overset{R_8}{\overset{|}{N}}-\overset{O}{\overset{\|}{C}}-\overset{R_8}{\overset{|}{N}}-,\ -\overset{O}{\overset{\|}{C}}-\overset{R_8}{\overset{|}{N}}-,\ -O-\overset{O}{\overset{\|}{C}}-O,\ -O-\overset{O}{\overset{\|}{C}}-\overset{R_8}{\overset{|}{N}}-,$$

$$-\overset{R_8}{\overset{|}{N}}-\overset{O}{\overset{\|}{C}}-O-,\ -\overset{R_8}{\overset{|}{N}}-SO_2-,\ -\overset{R_8}{\overset{|}{N}}-SO_2-\overset{R_9}{\overset{|}{N}}-,\ -SO_2-\overset{R_8}{\overset{|}{N}}-,$$

$$-SO-,\ -SO_2-,\ -SO_3-,\ -OSO_2-,\ \text{or}\ -S-.$$

$R_7$ is a substituent that does not adversely affect the coupler or the dye formed, such as alkyl, for example alkyl containing 1 to 30 carbon atoms, including methyl, ethyl, propyl, t-butyl, n-butyl, octyl, and eicosyl; aryl, such as aryl containing 6 to 30 carbon atoms, for example phenyl, mesityl and naphthyl; or a heterocyclic group, such as a 5- or 6-member heterocyclic group comprised of atoms selected from carbon, nitrogen, oxygen and sulfur atoms necessary to complete a 5- or 6-member heterocyclic ring, for example an oxazolyl, pyrrolyl, pyridyl or thienyl ring.

$R_8$ and $R_9$ are individually alkyl, such as alkyl containing 1 to 40 carbon atoms, for example methyl, ethyl, propyl, butyl, and eicosyl; aryl, such as aryl containing 6 to 30 carbon atoms, for example phenyl, mesityl, and naphthyl; or heterocyclic, such as a 5- or 6-member heterocyclic group comprised of atoms selected from carbon, oxygen, nitrogen and sulfur atoms necessary to form a 5- or 6-member ring, for example pyrrolyl, oxazolyl and pyridyl.

Examples of groups useful in other positions on the pyrazoloazole nucleus not occupied by the ballast group are as follows:

t-butyl
methyl
phenyl
2-propyl
t-octyl

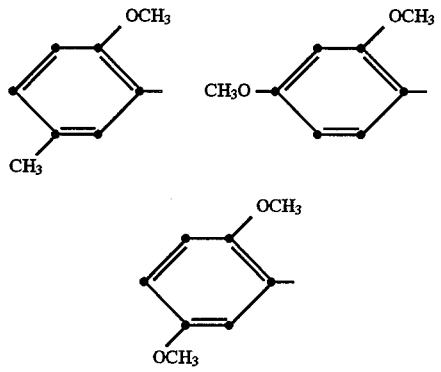

-continued

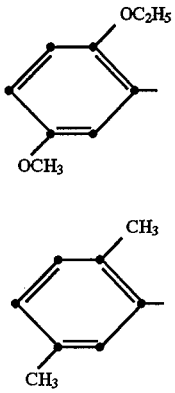

The pyrazolotriazole couplers contain in the coupling position hydrogen or a coupling-off group that is incapable of reducing silver. For example, a 1H-pyrazolo[3,2-c]-s-triazole as described contains in the 7-position hydrogen or a coupling-off group that is incapable of reducing silver.

Coupling-off groups, defined by Z herein, are well known to those skilled in the photographic art. Such groups can determine the equivalency of the coupler, can modify the reactivity of the coupler, or can advantageously affect the layer in which the coupler is coated or other layers in the element by performing, after release from the coupler, such functions as development inhibition, bleach acceleration, color correction, development acceleration and the like. It is important that the coupling-off group be incapable of reducing silver in order that the coupling-off group not cause undesirable changes in image formation. Representative classes of coupling-off groups include halogen, alkoxy, aryloxy, heterocyclyloxy, sulfonyloxy, acyloxy, carbonamido, imido, heterocyclic, thiocyano, alkylthio, arylthio, heterocyclylthio, sulfonamido, phosphonyloxy and arylazo. They are described in, for example, U.S. Pat. Nos. 2,355,169; 3,227,551; 3,432,521; 3,476,563; 3,617,291; 3,880,661; 4,052,212 and 4,134,766; and in U.K. Patents and published patent applications 1,466,728; 1,531,927; 1,533,039; 2,006,755A and 2,017,704A, the disclosures of which are incorporated herein by reference.

Examples of specific coupling-off groups are as follows:

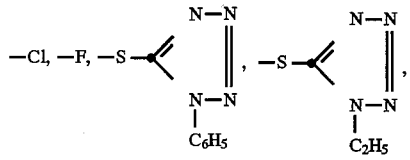

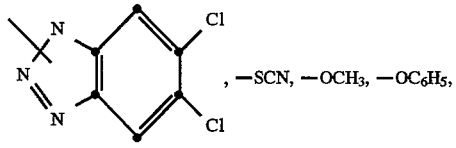

$-OCH_2CONHCH_2CH_2OH$, $-OCH_2CONHCH_2CH_2OCH_3$, $-OCH_2CONHCH_2CH_2OCOCH_3$,

-continued

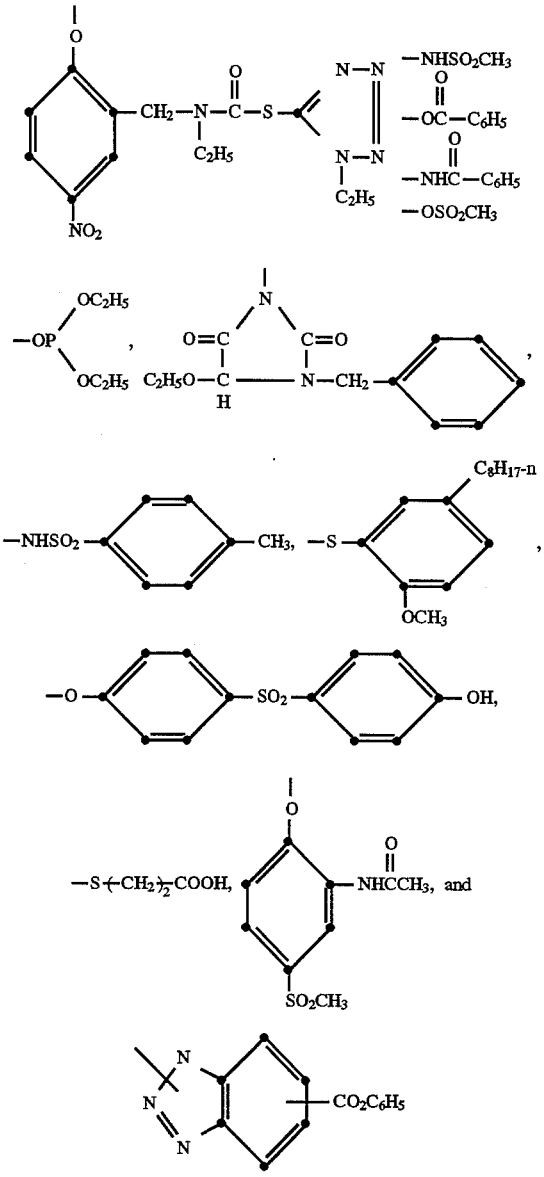

The coupling-off group as described can contain a water-solubilizing group, such as a carboxy group. The total hydrophilicity of the coupler and the dye formed from the coupler should not be high enough to cause the coupler and the dye formed to be mobile in the photographic element.

The ballast group, as described, is an organic radical of such size and configuration as to confer on the coupler molecule sufficient bulk to render the coupler immobile, that is sufficiently non-diffusible from the layer and the position in the layer in which it is coated in a photographic element. The coupler can optionally contain other ballast groups than the ballast group containing the carboxy group or sulfonic acid group as described. Couplers of the invention can optionally be attached to polymeric chains through one or more of the described groups on the coupler moiety, such as the leaving group or the 2-, 3- and/or 6-position substituents. Representative substituents on such a ballast group not containing a carboxy group or sulfonic acid group include alkyl, aryl, alkoxy, aryloxy, amino, carbonamido, carbamoyl, alkanesulfonyl, arenesulfonyl, sulfonamido, —S—, —SO—, —$SO_2$—, —$SO_3$—, —$OSO_2$—, and sulfamoyl substituents.

Pyrazolotriazole couplers of the invention are prepared by the general method of synthesis described in Research Disclosure, August 1974, Item No. 12443 published by Kenneth Mason Publications, Ltd. The Old Harbourmaster's, 8 North Street, Emsworth, Hampshire P010 7DD, England and U.S. Pat. No. 4,540,654.

The compounds of the invention are prepared by one of a number of routes exemplified by the following synthesis examples illustrated in Scheme I, Scheme II and Scheme III.

(Et herein means ethyl ($C_2H_5$)).

(Ac herein means acetate (—$COCH_3$)).

($Ac_2O$ herein means acetic anhydride).

(Δ herein means with heating).

(Me herein means methyl).

(THF herein means tetrahydrofuran).

(HOAc herein means acetic acid).

(EtOH herein means ethanol).

Scheme I:

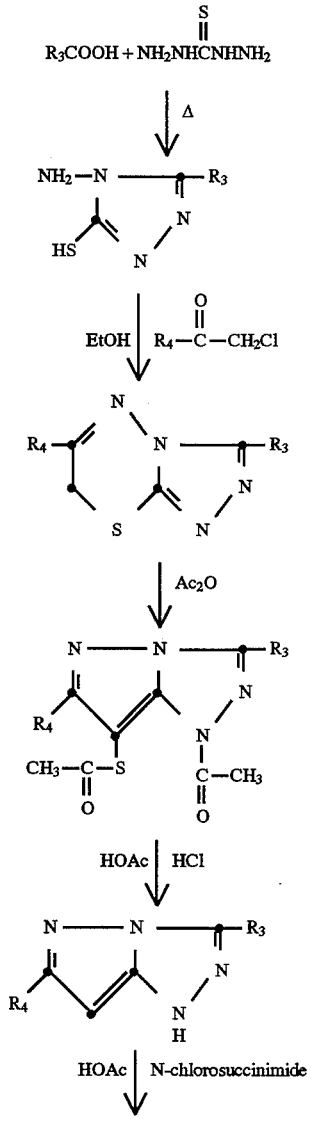

Scheme I:
-continued
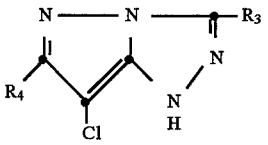
Synthesis Example A
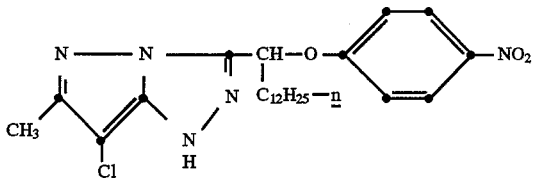
12
Zn
HOAc
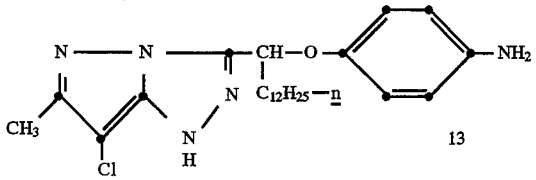
13
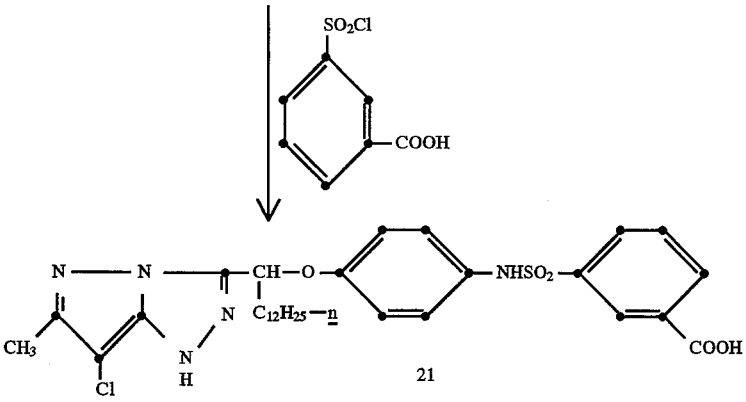
21
11.6 gm of 12 was dissolved in 50 ml HOAc and kept at or below 20° C. while 12 grams zinc dust was added portionwise. After stirring one hour, the reaction mixture was added to water. Ethyl acetate was added and the organic layer washed, dried, and evaporated to a brown gum and triturated with $Et_2O$ to give 13 (8.3 gm) as a light tan solid.

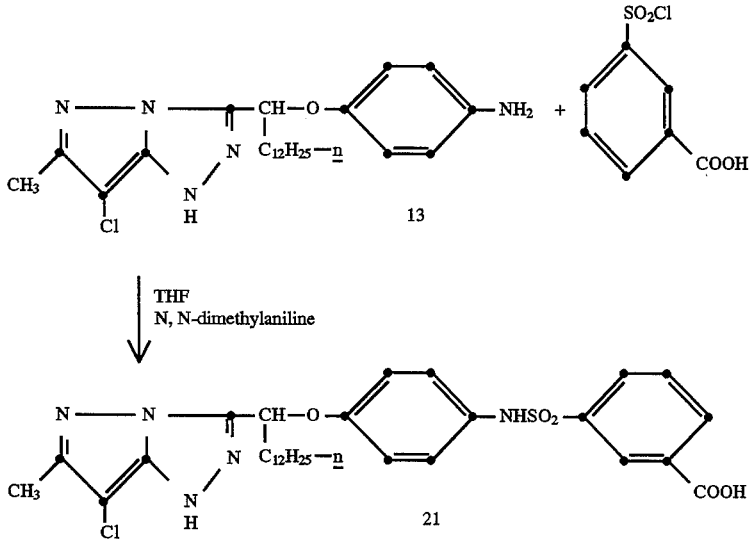

4.0 gm (0.0088 mol) of 13 were suspended in 40 ml THF and 2.0 gm (0.0090 mol) m-(chlorosulfonyl)-benzoic acid were added followed by 2.4 ml (0.018 mol) N,N-dimethylaniline. After stirring one hour the reaction mixture was added to dilute HCl and extracted with ether. The ether extracts were washed with water, dried and evaporated to give 5.2 gm crude oil. The product was chromatographed on silica gel and crystallized from acetonitrile to give 2.8 g of the desired product (Compound 21) as a white solid.

Elemental Analysis: Theoretical: C: 59.1; H:6.4; N: 11.1 Found : C: 59.0; H: 6:3; N: 11.1. NMR Analysis δ: 0.90 (t,3H); 0.93–1.55 (m,20H); 2.00–2.4 (m,s,5H); 5.25 (t,1H); 6.75 (d,2H); 6.85 (d,2H); 7.38 (t,1H); 7.72 (d,1H); 8.07 (d,1H); 8.32 (s,1H); 8.98 (s,1H).

Synthesis Example B (Preparation of Comparison Ester Compound)

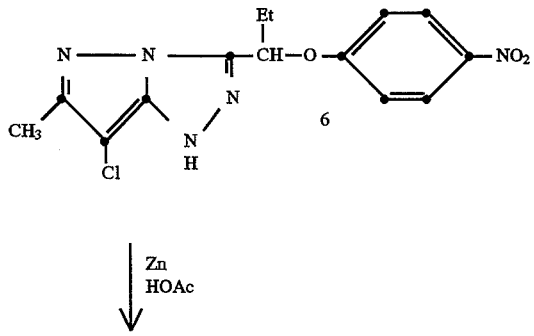

-continued

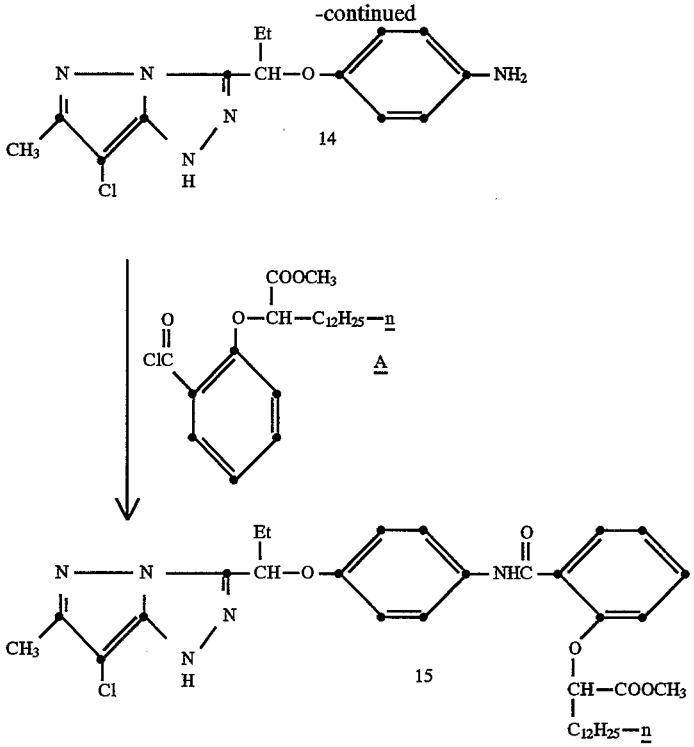

In this synthesis compound 6 was reduced 14 in the same manner as 12 was reduced to 13 in Synthesis Example A.

To 3.0 gm of 14 dissolved in 50 ml acetic acid was added 3.5 gm acid chloride (A) and the solution stirred for 15 minutes. The mixture was added to water and extracted with ethyl acetate. The ethyl acetate solution was washed with water, dried, evaporated and chromatographed on silica gel to provide 2.8 gm of the desired intermediate 15.

The counterpart acid compound can then be prepared as follows:

2.8 gm of 15 was dissolved in 10 ml THF and 10 ml MeOH and 5 ml of a 50% NaOH in water solution was added to dilute acid and stirred 10 minutes. The mixture was added to dilute acid and extracted with ethyl acetate. The organic layer was washed with water, dried, evaporated and chromatographed on silica gel to obtain 1.9 gm white solid (Compound 28) after triturating with $CH_3CN$.

Elemental Analysis: Theoretical: C: 64.5; H: 7.1; N: 10.7 Found: C: 63.7; H: 7.1; N: 10.3 NMR Analysis: $^1H$ NMR: δ 0.70–2.60 (m,31H); 5.0 (t,1H); 5.4 (t,1H); 6.8–8.3 (m,8H).

Synthesis Example C

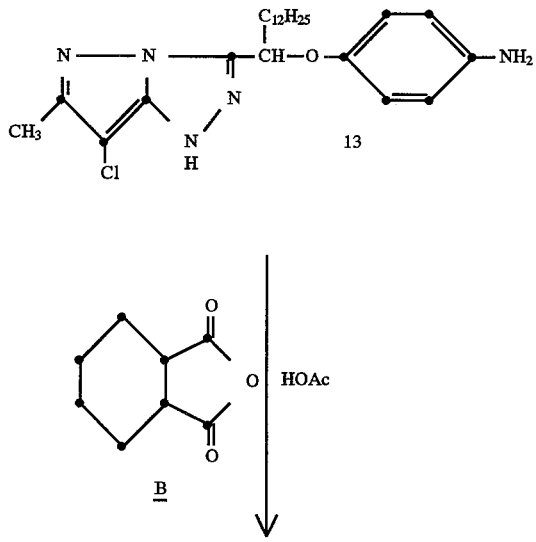

-continued

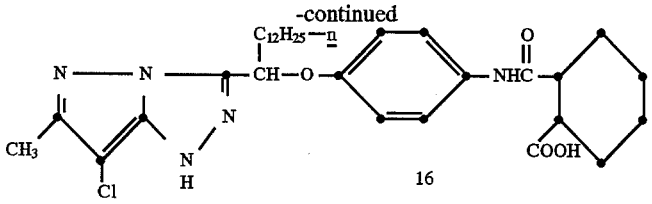

16

4.0 gm of 13 were dissolved in acetic acid and 1.28 gm anhydride added. After stirring one half hour the mixture was added to water and extracted with ethyl acetate. The organic layer was washed with water, dried and evaporated. After chromatography in silica gel, 2.5 gm white solid (Compound 16) was obtained, (mp 146 dec.).

Elemental Analysis: Theoretical: C: 64.1; H: 7.6; N: 11.7 Found: C: 63.9; H: 7.5; N: 11.7 $^1$H NMR: δ 0.8–3.0 (m,38H); 5.4 (t,1H); 6.9 (d,2H); 7.5 (d,2H); 9.1 (s,1H).

Scheme II:

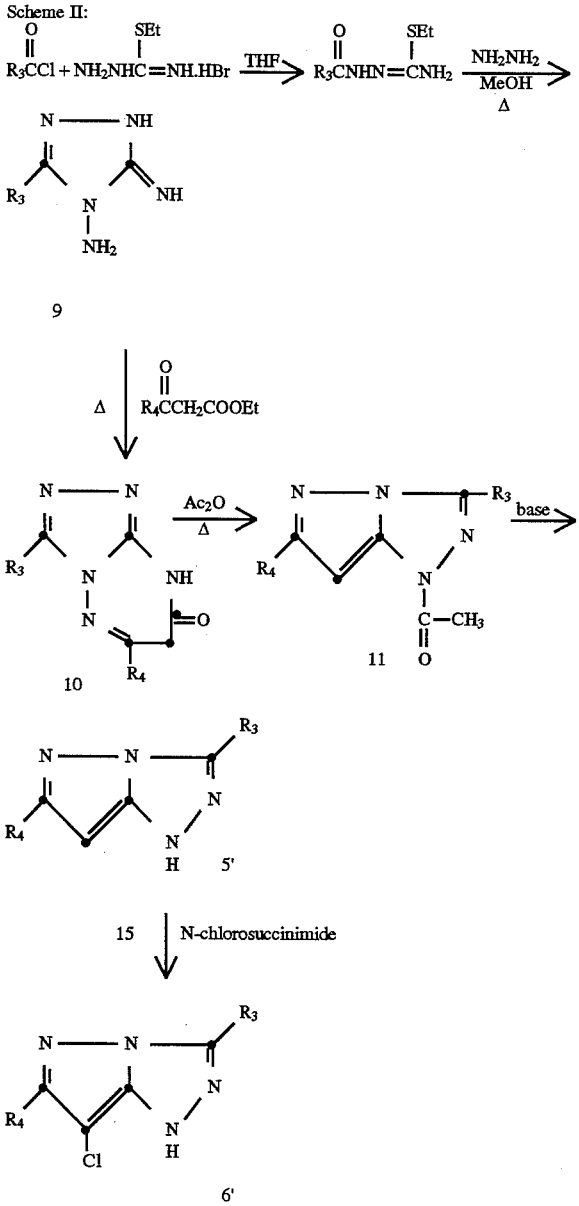

Synthesis Example D

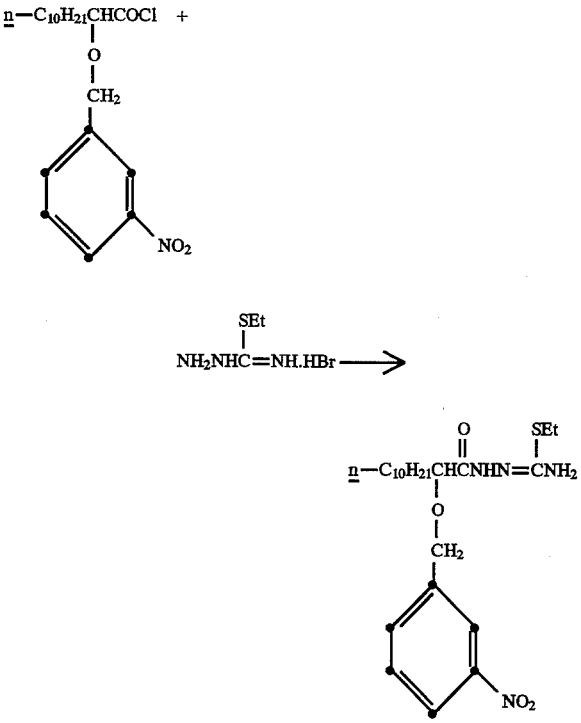

134.6 gm (0.364 mol) of above acid chloride and 73 gm (0.364 mol) of the above hydrobromide salt were stirred in THF for 2 hours. A complete solution was not obtained. The solvent was evaporated off and the resulting paste stirred in ligroin. The solid was filtered to give 180 gm pasty solid. The solid dissolved in 600 ml ethanol and 600 ml water, and 42 ml conc. $NH_4OH$ added slowly followed by 3500 ml cold water. After stirring 2.5 hours, a solid was filtered off and crystallized from $CH_3CN$ to give 85 gm white solid.

Elemental Analysis: Theoretical: C: 58.4; H: 8.0; N: 12.4; S: 7.1. Found: : C: 58.4; H: 7.9; N: 12.5; S: 7.1. NMR Analysis: $^1$H NMR: δ 0.80–0.90 (t,3H); 1.10–1.59 (m,16H); 1.75–2.70 (m,2H); 4.32–4.75 (m,4H); 5.0 (s,2H); 5.65–6.00 (s,1H); 7.4 (t,1H); 7.64 (d,1H); 8.0 (d,1H); 8.1 (s,1H).

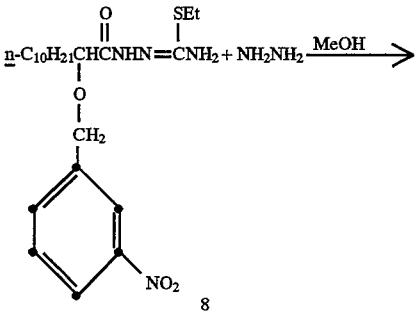

8

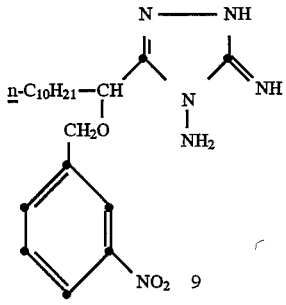

9

9.2 gm (0.288 mol) of hydrazine was added to a suspension of 87 gm (0.192 mol) of 8 in 230 ml methanol and refluxed 3.5 hours. Most of the methanol was evaporated and the residue treated twice with 500 ml water, mixed several minutes, and the aqueous layer decanted off. The residue was dissolved in 800 ml THF and dried with $MgSO_4$ and concentrated to a brown oil. The product was crystallized from $CH_3CN$ to give 46 gm of cream colored solid.

Elemental Analysis: Theoretical: C: 59.4; H: 8.0; N: 20.8; Found: C: 59.2; H: 7.7; N: 20.6.

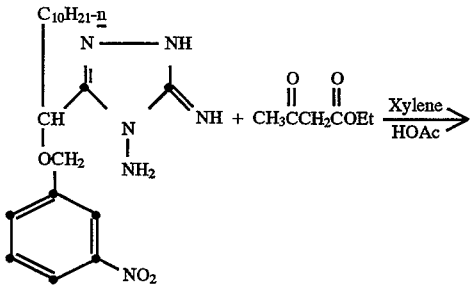

9

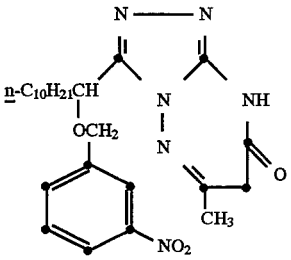

10

42.5 gm (0.105 mol) of 9 was heated 4 hours on a steam bath with 40 ml ethyl acetoacetate and 20 ml xylene and 6 ml acetic acid. After cooling the product was dissolved in $CH_2Cl_2$/EtOAc and chromatographed on silica gel changing to straight EtOAc to elute the product. The product was crystallized from $CH_3CN$ to give 20 gm solid.

Elemental Analysis: Theoretical: C: 61:3; H: 7.3; N: 17.9; Found: C: 61.2; H: 7.3; N: 17.9

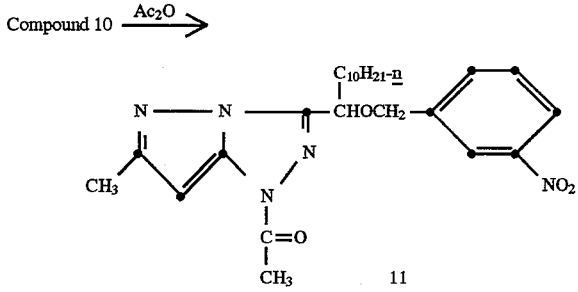

11

40 gm (0.084 mol) of 10 were refluxed one hour in 114 ml acetic anhydride. The product was poured into 31 water with rapid stirring and stirred 1½ hours. EtOAc was added and the organic layer washed, dried and evaporated to a brown oil. The product was chromatographed on silica gel with $CH_2Cl_2$ to give 30 gm white solid.

NMR Analysis: $^1H$ NMR: δ 0.85 (t,3H); 1.10–1.70 (m,16H); 2.05–2.31 (m,2H); 2.35 (s,3H); 2.60 (s,3H); 4.70 (s,2H); 4.75 (t,1H); 6.05 (s,1H); 7.45 (t,1H); 7.65 (d,1H); 8.05 (d,1H); 8.22 (s,1H).

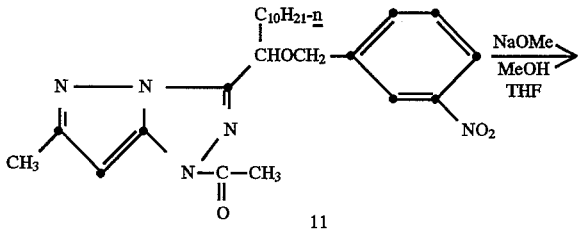

11

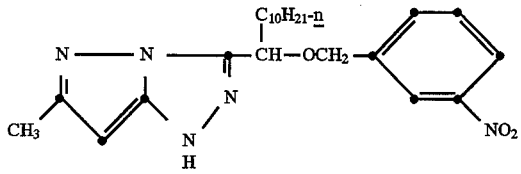

5'

28 gm (0.059 mol) 11 was dissolved in 50 ml THF and 50 ml methanol. 3.8 gm sodium methylate was added portion-wise, stirred 15 minutes and added to dilute HCl and extracted with EtOAc. The product was dried with $MgSO_4$ and concentrated to a light yellow solid. The product was triturated with ligroin and filtered to provide 25 gm of solid.

Compound 5' was converted to compound 6' having a chlorine atom in the 7-position in the same manner as compound 5 was converted to compound 6.

Elemental Analysis: Theoretical: C: 59.8; H: 7.0; N: 15.2 Found : C: 59.9; H: 6.8; N: 15.1 NMR Analysis: $^1H$ NMR: δ 0.87 (t,3H); 1.04–1.68 (m,16H); 1.95–2.38 (m,2H); 2.44 (s,3H); 4.59 (t,H); 7.22–7.71 (m,2H); 7.97–8.20 (m,2H).

5.0 gm (0.011 mol) of compound 6' was dissolved in 100 ml propionic acid and cooled to 0°. 2 ml concentrated HCl was added followed by 25 gm zinc dust added portion-wise. The solvent was evaporated and the residue taken up in ethyl acetate and washed with sodium bicarbonate. The product amine was dried over magnesium sulfate and concentrated to 5.2 gm orange oil.

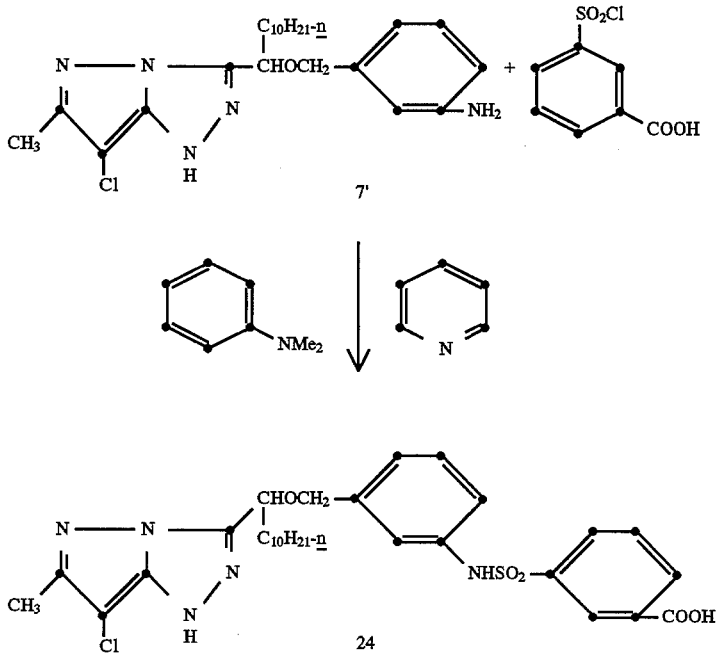

5.2 gm (0.011 mol) amine 7' was dissolved in 50 ml pyridine and 5 ml N,N-dimethylaniline. 2.6 gm (0.012 mol) m-(chlorosulfonyl)benzoic acid was added and after one hour the reaction poured into cold dilute HCl. Ethyl acetate was added and the organic layer washed, dried and evaporated to dark glass. The product was chromatographed on silica gel to obtain, after trituration with chlorobutane, a white solid (Compound 24), (3.2 gm) (mp 105°–107° C.).

Elemental Analysis: Theoretical: C: 58.5; H: 6.2; N: 11.4; S: 5.2 Found : C: 58.6; H: 6.1; N: 11.5; S: 5.4. NMR Analysis: $^1$H NMR: δ 1.0 (t,3H); 1.1–1.7 (m,16H); 2.0–2.3 (m,2H); 2.35 (s,3H); 4.40 (d,3H); 4.60 (6,1H); 6.90–7.30 (m,4H); 7.60 (t,1H); 7.90–8.27 (m,2H); 8.46 (s,1H); 10.25 (s,1H).

Synthesis Example E

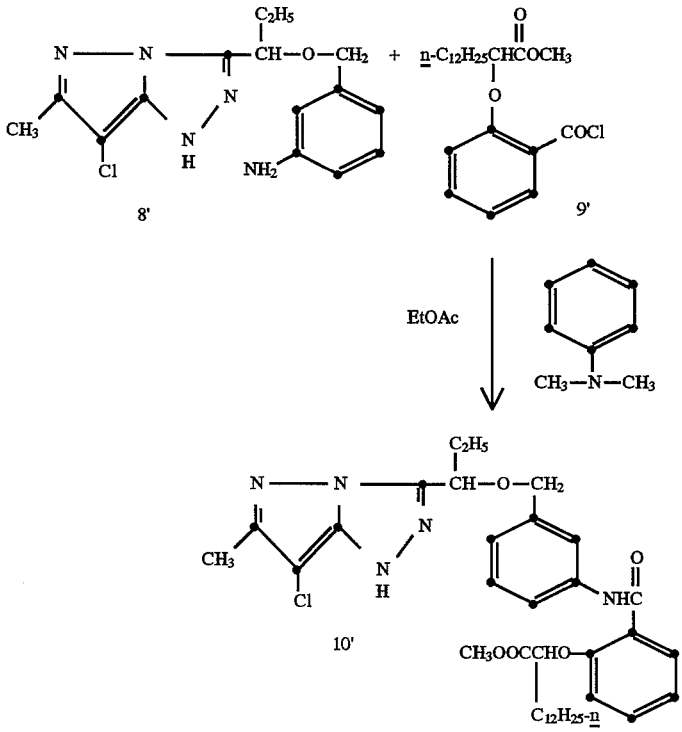

5.6 gm (0.0142 mol) of the ballast acid chloride 9' was added to a stirred solution of 4.5 gm (0.0142 mol) of the amine 8' which was synthesized in a manner analogous to the amine in Example E and 5 gm (0.04 mol) N,N-Dimethylaniline dissolved in 200 ml ethyl acetate. The reaction mixture was stirred at ambient temperature for one hour.

The reaction mixture was washed twice with 5% HCl solution, dried over $MgSO_4$ and concentrated to a brown oil. Chromatography through a column of silica gel yielded 8.5 gm light yellow oil.

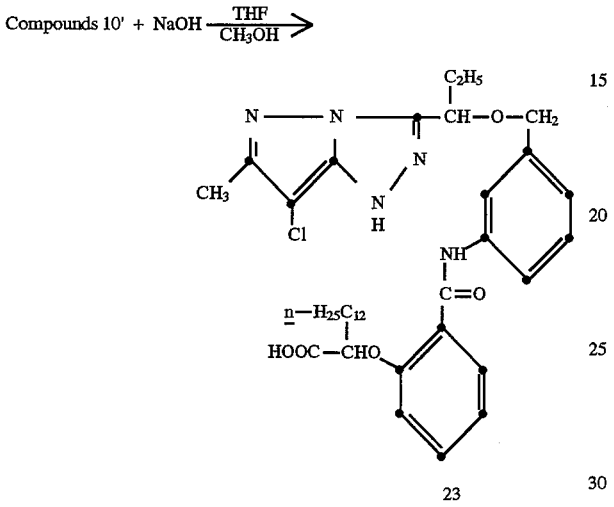

5 gm of sodium hydroxide dissolved in 30 ml water was added to a stirred solution of 8.5 gm of the ester 10' dissolved in 60 ml tetrahydrofuran and 40 ml methanol. The mixture was stirred at ambient temperature for 10 minutes.

The reaction mixture was poured into cold 5% HCl. The resulting oil was extracted with ethyl acetate, dried over $MgSO_4$ and concentrated to a glass.

Chromatography through a column of silica gel yielded 3.0 gm of 23, a white solid.

Elemental Analysis: Calculated: N: 10.5%; C: 64.9%; H 7.3% Found : N: 10.5%; C: 64.8%; H 7.0% NMR Analysis: 0.7–1.0 (m,6H); 1.05–1.72 (m,22H); 1.95–2.25 (m,4H); 5.05–5.15 (m,1H); 6.80–7.70 (m,6H); 7.90–8.30 (m2H); 10.5 (s,1H).

Synthesis Example F

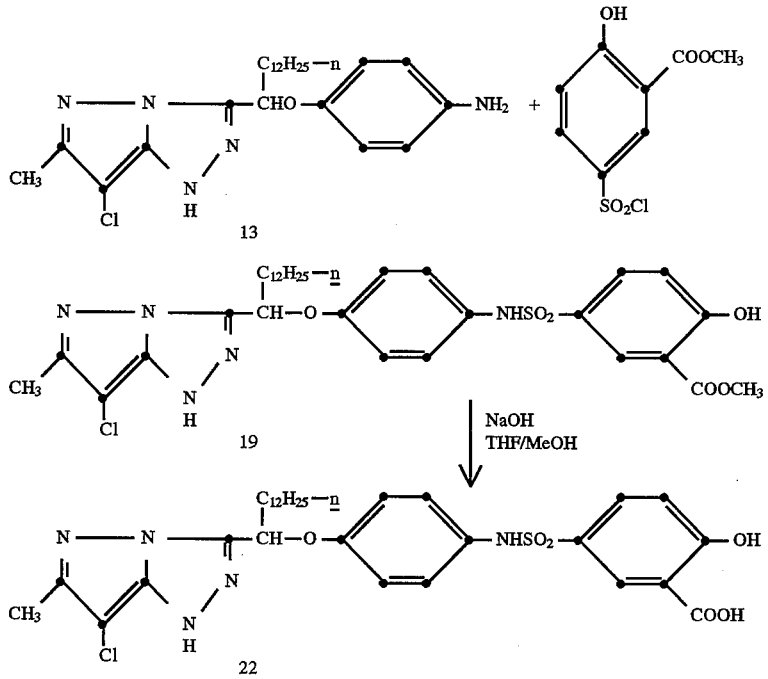

3.2 gm (0.0069 mol) 13 (prepared as in synthesis example A) was dissolved in 25 ml pyridine and 1.73 gm sulfonylchloride was added. After stirring ½ hour at room temperature the reaction mixture was poured into dilute HCl and extracted with ethyl acetate. The organic layers were washed with water, dried, and evaporated, and chromatographed on silica gel. The product was dissolved in 25 ml MeOH and 25 ml THF and 5 ml 50% sodium hydroxide solution added. After stirring 20 minutes, the reaction mixture was added to dilute HCl and extracted with ethyl acetate. The organic layers were washed with water, dried, and evaporated- The product was purified by chromatography and trituration with acetonitrile to yield 1.5 gm of white solid 22.

Elemental Analysis: Theoretical C: 57.6; H: 6.2; N: 10.8; Found C: 57.1; H: 6.0; N: 10.7.

Synthesis Example G

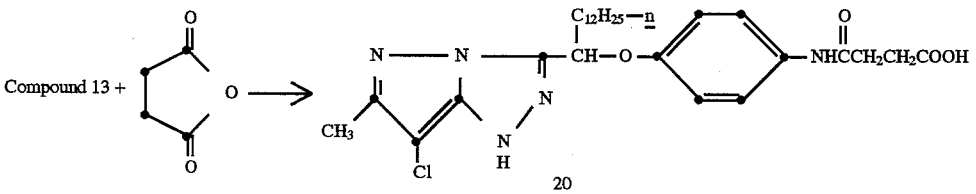

20

Compound 20 was prepared in the same manner from compound 13 as compound 11 was prepared from compound 10.

Elemental Analysis: Theoretical C: 61.6; H: 7.4; N: 12.8; Found C: 60.7; H: 7.1; N: 12.6. NMR Analysis: $^1$H NMR: δ 0.6–1.5 (m,25H); 2.1–2.7 (m,7H); 5.5 (t,1H); 6.9 (d,2H); 7.4 (d,2H).

Synthesis Example H

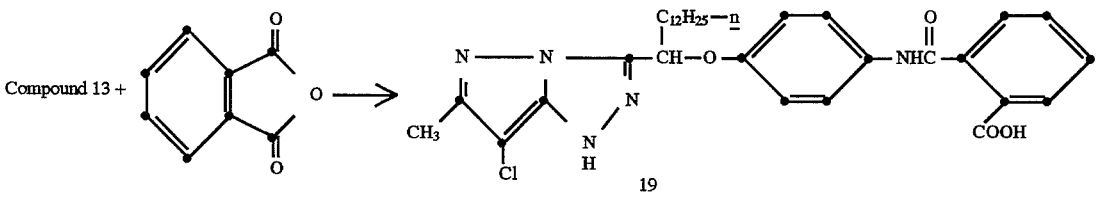

19

Compound 13 was prepared as in synthesis example A. It was reacted with the anhydride as in example B to form compound 19. The desired compound 23 was identified by Elemental Analysis and NMR Analysis: Theoretical C: 64.7; H: 6.8; N: 11.8; Found C: 64.4; H: 6.8; N: 11.8.

NMR Analysis: $^1$H NMR: δ 0.82 (t,3H); 0.85–1.60 (m,22H); 2.3 (s,3H); 5.55 (t,1H); 6.95 (d,2H); 7.5–7.7 (m,4H); 7.90 (d,2H).

Synthesis Example I

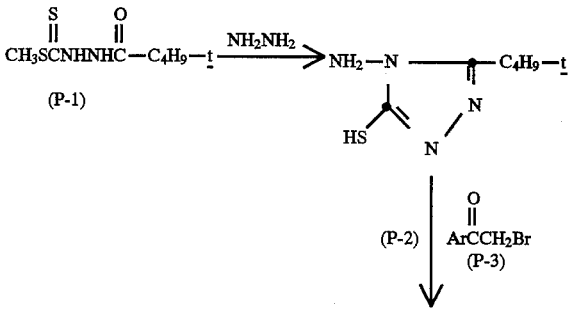

-continued

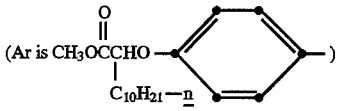

-continued

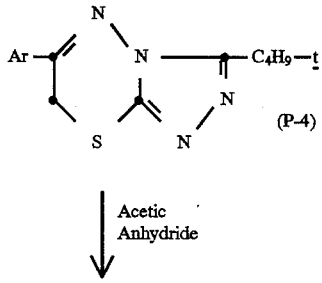

-continued

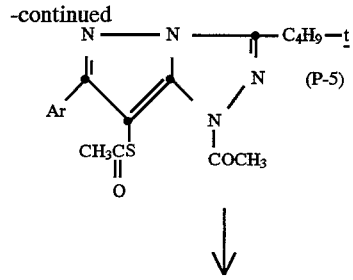

(P-5)

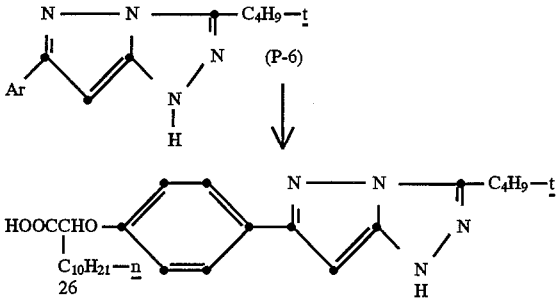

(P-6)

26

A solution of 2.92 gm (14.2 mmol) of compound P-1 and 2.85 gm (56.8 mmol) of hydrazine hydrate in 15 ml methanol was refluxed 2 hours, cooled, concentrated and acidified to provide 1.2 gm off-white crystals with nmr and mass spectra consistent with compound P-2. A solution of 4.8 gm (27.9 mmol) of compound P-2 and an equimolar amount of compound P-3 in 50 ml methanol was refluxed 20 hours, concentrated, neutralized with potassium carbonate solution, and filtered to provide 7.3 gm of tan solid with the expected nmr spectrum for compound P-4. This product was then refluxed in 20 ml acetic anhydride 20 minutes, concentrated, and triturated with hexane to yield 5.3 gm of off-white solid compound P-5. Next, refluxing a solution of Compound P-5 in 1.5 ml concentrated hydrochloric acid and 10 ml of methanol for 30 minutes provided, on workup, 3.9 gm orange glassy ester P-6. P-6 was then hydrolyzed by treating 20 minutes with 2.26 gm of potassium hydroxide in 20 ml each of water, methanol and tetrahydrofuran. Acidification, extraction, and isolation provided 3.0 gm of white solid compound 26. This product was identified by nmr and mass spectral analysis:

NMR Analysis: NMR (DMSO-$d_6$): δ (ppm) 0.85 (s,3H); 1.1–1.4 (s,16H); 1.45 (s,9H); 4.6 (t,1H); 6.0 (s,1H); 6.9 (d,2H); 7.85 (d,2H). FDMS: m/e 454

Synthesis Example J

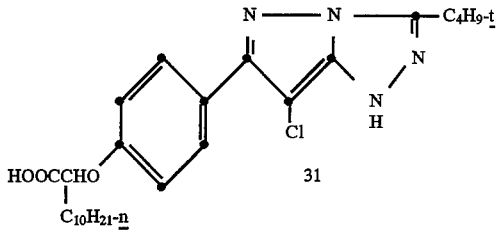

31

To prepare compound 31 a stirred solution of compound 26 (2.25 gm, 5 mmol) in 10 ml of dichloromethane and 5 ml of methanol was treated portionwise with 0.82 gm (6.3 mmol) of N-chloro-succinimide. A foamy solid product was isolated. This was dissolved in 10 ml methanol and treated with 0.92 gm (5.25 mmol) of ascorbic acid in 9.25 ml of 1N aqueous sodium hydroxide solution. Extraction and purification provided 1.9 gm of off-white solid compound 27. The product was identified by NMR and mass spectral analysis: 27: δ (ppm) 0.85 (m,3H); 1.1–1.4 (broad s, (6H); 1.55 (s,9H); 1.9–2.1 (m,2H); 4.75 (t,1H); 7.05 (d,2H); 7.95 (d,2H). FDMS: m/e 488 m.p. 108°–110° C.

The preparation of pyrazolo[2,3-b]-triazoles according to the invention can be carried out by procedures as described in, for example, U.S. Pat. No. 4,540,654 and exemplified in the following Scheme III:

Scheme III:

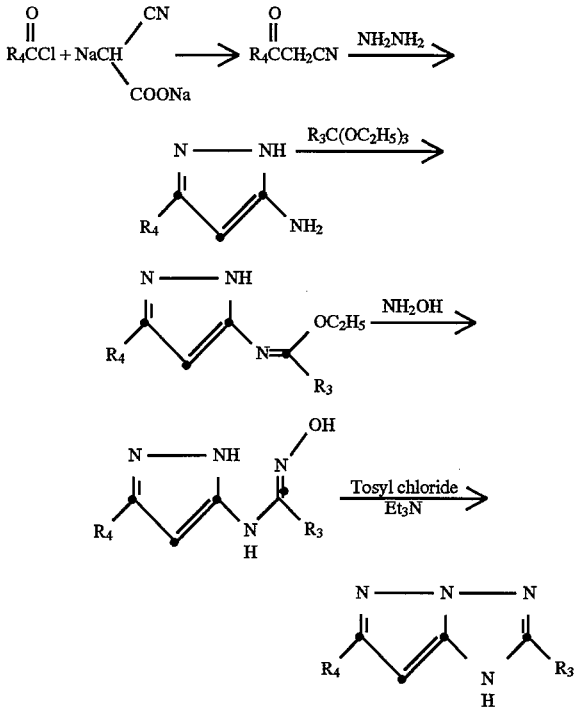

Examples of such compounds that can be prepared by this method are as follows:

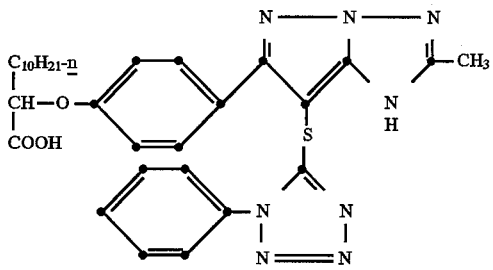

28

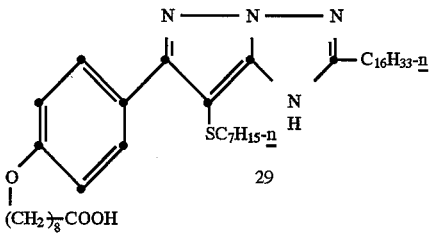

29

-continued

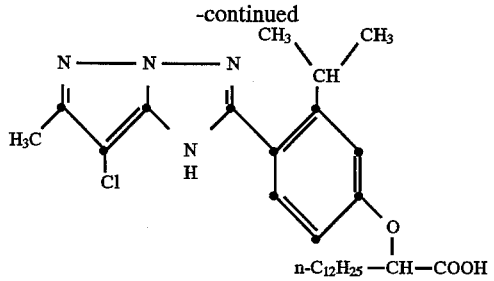

30

The pyrazolotriazole couplers of the invention can be used for purposes and in ways in photographic materials in which pyrazoloazole couplers are known to be useful in the photographic art.

The photographic elements can be single color elements or multicolor elements. In a multicolor element, the dye-forming coupler of this invention is typically associated with a green-sensitized emulsion, although it can be associated with an unsensitized emulsion or an emulsion sensitized to a different region of the spectrum. Multicolor elements typically contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsion sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the emulsions and elements of this invention, reference will be made to *Research Disclosure,* December 1978, Item No. 17643, the disclosures of which are incorporated herein by reference. This publication will be identified hereafter by the term *"Research Disclosure"*.

The silver halide emulsions employed in the elements of this invention can be either negative-working or positive-working. Suitable emulsions and their preparation are described in *Research Disclosure* Sections I and II and the publications cited therein. Suitable vehicles for the emulsion layers of elements of this invention are described in *Research Disclosure* Section IX and the publications cited therein.

The elements of the invention can include additional couplers as described in *Research Disclosure* Section VII, paragraphs D, E, F and G and the publications cited therein. These couplers can be incorporated in the elements and emulsion as described in *Research Disclosures* of Section VII, paragraph C and the publications cited therein.

The photographic elements of this invention or individual layers thereof, can contain, for example, brighteners (see *Research Disclosure* Section V), antifoggants and stabilizers (See *Research Disclosure* Section VI), antistain agents and image dye stabilizers (see *Research Disclosure* Section VII, paragraphs I and J), light absorbing and scattering materials (see *Research Disclosure* Section VIII), coating aids (see *Research Disclosure* Section XI), hardeners (see *Research Disclosure* Section X), plasticizers and lubricants (see *Research Disclosure* Section XII), antistatic agents (see *Research Disclosure* Section XIII), matting agents (see *Research Disclosure* Section XVI) and development modifiers (see *Research Disclosure* Section XXI) colored masking couplers, bleach accelerators and competing couplers.

The photographic elements can be coated on a variety of supports as described in *Research Disclosure* Section XVII and the references described therein.

Photographic elements can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-β-(methanesulfonamido) ethylaniline sulfate hydrate, 4-amino-3-methyl-N-ethyl-N-β-hydroxyethyl-aniline sulfate, 4-amino-3-β-(methanesulfonamido)ethyl-N,N-diethylaniline hydrochloride and 4-amino-N-ethyl-N-(2-methoxyethyl)-m-toluidine-di-p-toluenesulfonic acid.

With negative working silver halide this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following examples further illustrate the invention.

Example 1

(Photographic Elements Comprising Pyrazolotriazole Couplers of the Invention)

Photographic elements were prepared by coating a cellulose acetate-butyrate film support with a photosensitive layer containing a silver bromoiodide emulsion at 0.91 gm Ag/m$^2$, gelatin at 3.77 gm/m$^2$, and one of the couplers designated in the following Table I dispersed in half its weight of tricresyl phosphate and coated at 1.62 mmole/m$^2$. The photosensitive layer was overcoated with a layer containing gelatin at 1.08 gm/m$^2$ and bis-vinyl-sulfonylmethyl ether at 1.75 weight percent based on total gelatin.

Samples of each element were imagewise exposed through a graduated-density test object and processed at 40° C. employing the following color development solution, then stopped, bleached, fixed, washed, and dried to produce stepped magenta dye images.

| | |
|---|---|
| $K_2SO_3$ | 2.0 gm |
| $K_2CO_3$ | 30.0 gm |
| KBr | 1.25 gm |
| KI | 0.6 mg |
| 4-Amino-3-methyl-N-ethyl-N-2'-hydroxyethylaniline sulfate | 3.55 gm |
| Water to 1.0 liter, pH 10.0 | |

Sensitometry of these processed elements provided the maximum density (Dmax) and relative gamma (G) values presented in the following tables. The G value in each case was obtained by dividing the gamma (contrast) of each sample by that of control coupler C-9 processed in the same set.

The formula of Coupler C-9 is:

C-9

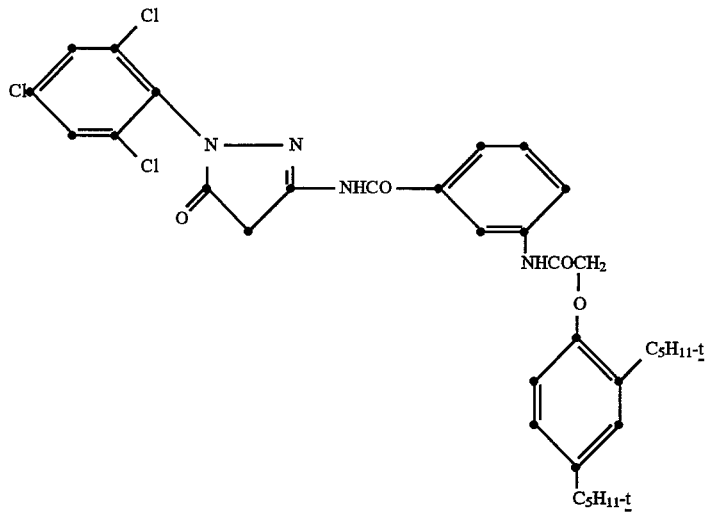

It can be seen from the data that coupler activity evidenced by the Dmax and especially the G values is generally higher for compounds of the invention than for the comparison compounds (C-numbers in the tables). The combination of high Dmax, high G value and desired hue is particularly important. Compounds of the invention provide such a combination whereas comparison compounds do not.

TABLE I

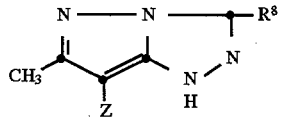

Z is Cl, except as noted. Ph herein is phenyl.

| Example No. | Dmax | G | $R_8$ | (Hue as the wavelength of maximum absorption of the dye formed is given in parenthesis after the $R_8$ group) |
|---|---|---|---|---|
| C-1 | 3.49 | 1.37 | $-(CH_2)_3-Ph\text{-}p\text{-}NHCOCHO-Ph\text{-}4\text{-}SO_2-Ph\text{-}4'\text{-}OH$ (CHO: $C_{10}H_{21}$-n) | (555) |
| C-2 | 4.03 | 2.29 | $-(CH_2)_3-Ph\text{-}p\text{-}NHCO-Ph\text{-}2\text{-}OCHCOOH$ (CH: $C_{12}H_{25}$-n) | (552) |
| C-4 | 3.95 | 1.83 | $-(CH_2)_3-Ph\text{-}p\text{-}NHCO$ 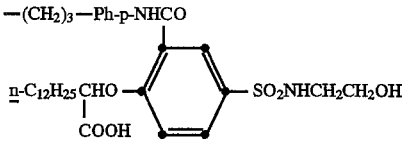 | (553) |

TABLE I-continued

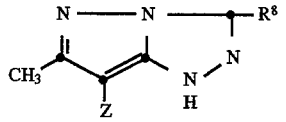

Z is Cl, except as noted. Ph herein is phenyl.

| Example No. | Dmax | G | $R_8$ | (Hue as the wavelength of maximum absorption of the dye formed is given in parenthesis after the $R_8$ group) |
|---|---|---|---|---|
| C-5 | 3.02 | 1.58 | $-(CH_2)_3-$Ph-p-NHCO$\underset{\underset{C_{12}H_{25}\text{-}\underline{n}}{\vert}}{C}$HO—Ph-4-NHCO$CH_2CH_2$COOH | (554) |
| 1 | 3.99 | 2.22 | 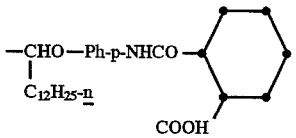 | (563) |
| C-6 | 3.46 | 1.72 | 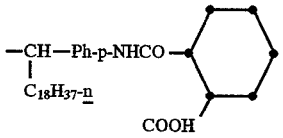 | (547) |
| 2 | 2.92 | 1.75 | —CHO—Ph-p-NHCO$CH_2$COOH<br>$C_{12}H_{25}$-n | (565) |
| 3 | 2.89 | 2.15 | —CHO—Ph-p-NHCO—Ph-2-COOH<br>$C_{12}H_{25}$-n | (562) |
| 4 | 2.90 | 2.22 | —CHO—Ph-p-NHCO$CH_2CH_2$COOH<br>$C_{12}H_{25}$-n | (565) |
| 5 | 3.31 | 2.84 | —CHO—Ph-p-$NHSO_2$—Ph-3-COOH<br>$C_{12}H_{25}$-n | (562) |
| C-7 | 2.71 | 1.21 | 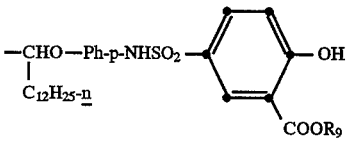 <br>$R_9$ is $-CH_3$ | (559) |
| 6 | 3.62 | 2.43 | 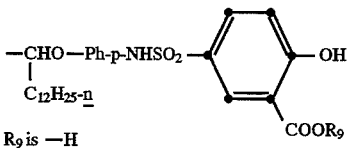 <br>$R_9$ is —H | (565) |
| 7 | 3.89 | 2.40 | —CH$OCH_2$—Ph-m-NHCO—Ph-2-OCHCOOH<br>$C_2H_5$ $C_{12}H_{25}$-n | (561) |
| 8 | 3.97 | 2.55 | —CH$OCH_2$—Ph-m-$NHSO_2$Ph-3-COOH<br>$C_{10}H_{21}$-n | (558) |
| 9 | 3.49 | 1.69 | —CH$OCH_2$—Ph-m-$NHCO_2$—Ph-3-COOH<br>$C_{10}H_{21}$-n | (562) |

TABLE I-continued

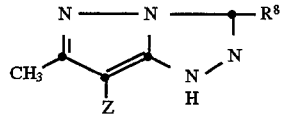

Z is Cl, except as noted. Ph herein is phenyl.

| Example No. | Dmax | G | $R_8$ | (Hue as the wavelength of maximum absorption of the dye formed is given in parenthesis after the $R_8$ group) |
|---|---|---|---|---|
| 10 | 3.90 | 1.97 | 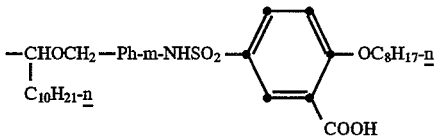 | (560) |
| 11 | 3.61 | 1.83 | 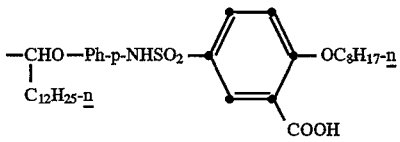 | (563) |
| 12 | 3.97 | 2.37 | —CHO—Ph-p-NHCO—Ph-2-OCHCOOH<br>\| \|<br>$C_2H_5$ $C_{12}H_{25}$-n | (560) |

TABLE II

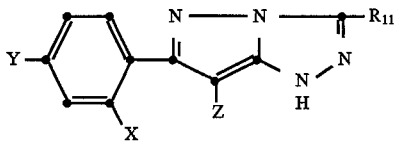

Z = Cl, except as noted.

| Example No. | Dmax | G | $R_{11}$ | X | Y | |
|---|---|---|---|---|---|---|
| C-9 | 1.31 | 0.93 | $-CH_3$ | —H | $C_{10}H_{21}$-n<br>\|<br>$-OCHCOOC_2H_5$ | (566) |
| 14 | 2.91 | 1.56 | $-CH_3$ | —H | —OCHCOOH<br>\|<br>$C_{10}H_{21}$-n | (565) |
| 15 | 3.65 | 1.78 | $-C_4H_9$-t | —H | —OCHCOOH<br>\|<br>$C_{10}H_{21}$-n | (575) |
| C-10 | 1.02 | 0.38 | $-C_4H_9$-t | $-CH_3$ | $-OCHCOOR_{12}$<br>\|<br>$C_{10}H_{21}$-n | (564) |
| 16 | 3.62 | 1.84 | $-C_4H_9$-t | $-CH_3$ | —OCHCOOH<br>\|<br>$C_{10}H_{21}$-n | (564) |
| C-11 | 1.00 | 0.45 | $-C_4H_9$-t | $-OCHCOOC_2H_5$<br>\|<br>$C_{10}H_{21}$-n | —H | (557) |
| 17 | 1.99 | 1.24 | $-C_4H_9$-t | —OCHCOOH<br>\|<br>$C_{10}H_{21}$-n | —H | (560) |
| 18 | 2.95 | 1.72 | $-C_4H_9$-t | —OCHCOOH<br>\|<br>$C_{10}H_{21}$-n | —H (Z is —H) | (565) |

The following examples were also carrier out using the same procedure as in Example 1 with the substitution of the pyrazolotriazole coupler as noted in the following Table III wherein $R_8$ refers to the formula in Table I. (HBW is half-band width.) Unless otherwise indicated, the hydrocarbon groups are normal.)

TABLE III

| Example No. | Dmax | G | Speed | Hue | HBW | $R_8$ |
|---|---|---|---|---|---|---|
| C-1 | 3.57 | 1.41 | 354 | 555 | 86 | —$(CH_2)_3$-Ph-p-NHCOCH($C_{10}H_{21}$)O-Ph-4'-OH |
| 19 | 3.82 | 2.24 | 376 | 569 | 86 | —CH($C_{16}H_{33}$)$SO_2CH_2$-Ph-m-$NHSO_2$-Ph-3-COOH |
| 20 | 3.96 | 2.92 | 376 | 567 | 89 | —CH($C_{16}H_{33}$)$SOCH_2$-Ph-m-$NHSO_2$-Ph-3-COOH |
| 21 | 3.98 | 2.58 | 354 | 561 | 86 | —CH($C_{16}H_{33}$)$SCH_2$-Ph-m-$NHSO_2$-Ph-3-COOH |
| 22 | 3.49 | 1.69 | 346 | 562 | 81 | —CH($C_{10}H_{21}$)$OCH_2$Ph-m-NHCO-Ph-3-COOH |
| C-12 | 2.32 | 1.20 | 381 | 556 | 78 | —CH($C_2H_5$)O-Ph-p-NHCOCH($C_2H_5$)O-Ph-3-$C_{15}H_{31}$ |

The following examples were also carrier out using the same procedure as in Example 14 with the substitution of the pyrazolo-triazole coupler as noted in the following Table IV wherein $R_{11}$ refers to the formula in Table II and $R_{12}$ refers to the substituent in the 6- position of the pyrazolotriazole in Table II.

TABLE IV (Z = Cl unless otherwise noted).

| Example No. | Dmax | G | Speed | Hue | HBW | $R_{11}$ | $R_{12}$ |
|---|---|---|---|---|---|---|---|
| 23 | 3.11 | 3.12 | 382 | 562 | 94 | —$C_4H_9$-t | -Ph-2-$OCH_3$-4-OCH($C_{10}H_{21}$)COOH |
| 24 | 2.55 | 0.95 | 302 | 563 | 98 | —$CH_3$ | -Ph-2-$CH_3$-4-OCH($C_{10}H_{21}$)COOH |

The invention has been described in detail with particular reference to preferred embodiments thereof, but it will be understood that variations and modifications can be effected within the spirit and scope of the invention.

What is claimed is:

1. A photographic element comprising a support bearing at least one photographic silver halide emulsion layer and a dye-forming pyrazolotriazole coupler wherein the pyrazolotriazole coupler comprises a ballast group containing from 14 to 40 carbon atoms and having one water-solubilizing group on the ballast group and having an ether group (—O—) bonded directly to a carbon atom that is bonded directly to the pyrazolotriazole nucleus;

wherein the pyrazolotriazole is capable of forming an immobile dye in a gelatino silver halide emulsion and is free of coupling-off groups that reduce silver.

2. The element of claim 1 wherein the ballast group comprises a secondary carbon bonded directly to the pyrazolotriazole nucleus.

3. The element of claim 1 wherein the pyrazolotriazole coupler is a 1H-pyrazolo[3,2-c]-s-triazole coupler.

4. A process for forming an image in an element as described in claim 1 after the element has been exposed comprising contacting the element with a color developing agent.

5. The process of claim 4 wherein the color developing agent is a paraphenylene diamine compound.

6. A photographic element comprising a support bearing at least one photographic silver halide emulsion layer and a dye-forming pyrazolotriazole coupler wherein the pyrazolotriazole coupler comprises a ballast group containing from 14 to 40 carbon atoms and having one water-solubilizing group on the ballast group and having an ether group (—O—) bonded directly to a carbon atom that is bonded directly to the pyrazolotriazole nucleus;

wherein the pyrazolotriazole is capable of forming an immobile dye in a gelatino silver halide emulsion and is free of coupling-off groups that reduce silver, wherein the ballast group is selected from the group consisting of

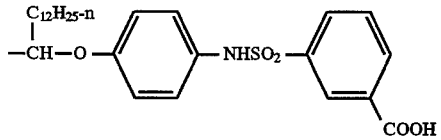

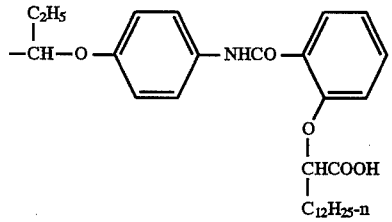

and

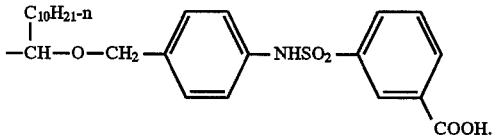

7. A photographic element comprising a support bearing at least one photographic silver halide emulsion layer and a dye-forming pyrazolotriazole coupler wherein the pyrazolotriazole coupler comprises a ballast group containing from 14 to 40 carbon atoms and having one water-solubilizing group on the ballast group and having an ether group (—O—) bonded directly to a carbon atom that is bonded directly to the pyrazolotriazole nucleus;

wherein the pyrazolotriazole is capable of forming an immobile dye in a gelatino silver halide emulsion and is free of coupling-off groups that reduce silver, wherein the solubilizing group is a carboxy group.

8. A photographic element comprising a support bearing at least one photographic silver halide emulsion layer and a dye-forming pyrazolotriazole coupler wherein the pyrazolotriazole coupler comprises a ballast group containing from 14 to 40 carbon atoms and having one water-solubilizing group on the ballast group and further having a group $$-\overset{\overset{\displaystyle O}{\|}}{C}O-,$$

—S—, —SO—, $—SO_3—$, or $—OSO_2—$ bonded directly to a carbon atom that is bonded directly to the pyrazolotriazole nucleus;

wherein the pyrazolotriazole is capable of forming an immobile dye in a gelatino silver halide emulsion and is free of coupling-off groups that reduce silver.

9. The element of claim 8 wherein the solubilizing group is a carboxy group.

10. The element of claim 8 wherein the ballast group comprises a secondary carbon bonded directly to the pyrazolotriazole nucleus.

11. The element of claim 8 wherein the pyrazolotriazole coupler is a 1H-pyrazolo[3,2-c]-s-triazole coupler.

12. A photographic element as in claim 8 wherein the ballast group contains from 14 to 40 carbon atoms and is represented by the formula:

$$—Y—(X)_m—(L—W)_n—L^1—SOL$$

wherein

Y is $$-\overset{\overset{\displaystyle R_1}{|}}{\underset{\underset{\displaystyle R_2}{|}}{C}}-;$$

X is:

$$-\overset{\overset{\displaystyle O}{\|}}{C}O-,$$

—S—, —SO—, $—SO_3—$, or $—OSO_2—$;

m is 1;

L and $L^1$ individually are unsubstituted or substituted hydrocarbon groups;

W is —O—, $$-\overset{\overset{\displaystyle O}{\|}}{C}O-,$$

—CO—, —S—, —SO—, $—SO_2—$, $—SO_3—$, $—OSO_2—$, $—NR_{3a}—$, $—NR_{3a}CO—$, $—NR_{3a}CONR_{2a}—$, $—CONR_{4a}—$, $—NR_{3a}SO_2—$, $—NR_{3a}SO_2NR_{4a}—$, or $—SO_2NR_{4a}—$;

$R_1$ and $R_2$ individually are hydrogen, alkyl, aryl, alkoxy, alicyclic, or heterocyclic substituents;

$R_{2a}$, $R_{3a}$ and $R_{4a}$ individually are hydrogen, alkyl, aryl, alicyclic or heterocyclic substituents;

n is 0 or a positive integer;

provided that each L can be the same or different from other L groups and each W can be the same or different from other W groups; and SOL is a carboxy or sulfonic acid water-solubilizing group.

13. A process for forming an image in an element as described in claim 8 after the element has been exposed, comprising contacting the element with a color developing agent.

14. The process of claim 13 wherein the color developing agent is a paraphenylene diamine compound.

15. A photographic element comprising a support beating at least one photographic silver halide emulsion layer and a dye-forming pyrazolotriazole coupler represented by the formula:

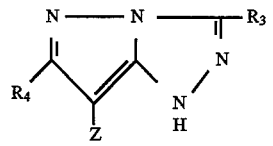

or

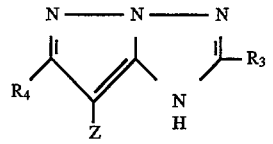

wherein

Z is a hydrogen or a coupling-off group incapable of reducing silver;

$R_3$ and $R_4$ am individually hydrogen or a substituent and wherein at least one of $R_3$ and $R_4$ is a ballast group represented by the formula:

$$—Y—(X)_m—(L—W)_n—L^1—SOL$$

wherein

Y is $$-\overset{\overset{\displaystyle R_1}{|}}{\underset{\underset{\displaystyle R_2}{|}}{C}}-;$$

X is $$-\overset{\overset{\displaystyle O}{\|}}{C}O-,$$

—S—, —SO—, $—SO_3—$, or $—OSO_2—$;

m is 1;

L and $L^1$ individually are unsubstituted or substituted hydrocarbon groups;

W is —O—, $$-\overset{\overset{\displaystyle O}{\|}}{C}O-,$$

—CO—, —S—, —SO—, $—SO_2—$, $—SO_3—$, $—OSO_2—$, $—NR_{3a}—$, $—NR_{3a}CO—$,

—$NR_{3a}CONR_{2a}$—, —$CONR_{4a}$—, —$NR_{3a}SO_2$—, —$NR_{3a}SO_2NR_{4a}$—, or —$SO_2NR_{4a}$—;

$R_1$ and $R_2$ individually are hydrogen, alkyl, aryl, alkoxy, alicyclic, or heterocyclic substituents;

$R_{2a}$, $R_{3a}$ and $R_{4a}$ individually are hydrogen, alkyl, aryl, alicyclic or heterocyclic substituents;

n is 0 or a positive integer;

provided that each L can be the same or different from other L groups and each W can be the same or different from other W groups; and SOL is a carboxy or sulfonic acid water-solubilizing group.

* * * * *